US005547090A

United States Patent [19]

Richter

[11] Patent Number: 5,547,090

[45] Date of Patent: Aug. 20, 1996

[54] APPARATUS FOR UNCOUPLING TRACK-GUIDED TOY VEHICLES

[75] Inventor: Michael Richter, Berlin, Germany

[73] Assignee: Ernst Paul Lehmann Patentwerk, Nuremberg, Germany

[21] Appl. No.: 427,521

[22] Filed: Apr. 24, 1995

[30] Foreign Application Priority Data

Apr. 25, 1994 [DE] Germany ..... 9406955 U
May 9, 1994 [DE] Germany ..... 9407916 U

[51] Int. Cl.[6] ..... B61G 7/04

[52] U.S. Cl. ..... 213/75 A; 213/75 TC; 213/211

[58] Field of Search ..... 213/75 A, 75 TC, 213/211, 213, 218

[56] References Cited

U.S. PATENT DOCUMENTS

| | | | |
|---|---|---|---|
| 1,887,753 | 11/1932 | Evans | 213/211 |
| 2,738,080 | 3/1956 | Kastner et al. | 213/211 |
| 3,338,429 | 8/1967 | Zetzsche | 213/75 TC |
| 3,450,272 | 6/1969 | Munzing | 213/75 TC |
| 3,662,489 | 5/1972 | Terrier | 213/75 TC |

FOREIGN PATENT DOCUMENTS

| | | |
|---|---|---|
| 1478361 | 8/1964 | Germany . |
| 3211874 | 3/1982 | Germany . |

*Primary Examiner*—S. Joseph Morano
*Attorney, Agent, or Firm*—Jordan and Hamburg

[57] ABSTRACT

Apparatus for automatically uncoupling track-guided toy vehicles includes a first coupling element pivotally mounted on one toy vehicle for pivotal movement between a coupling position and an uncoupling position and a second coupling element mounted on another toy vehicle. The first coupling element couples with the second coupling element when the first coupling element is in a coupling position, and the first coupling element uncouples from the second coupling element when the first coupling element is in an uncoupling position. A spring pivotally biases the first coupling element in the coupling position. A first pivotally suspends a pendulum from the first coupling member. A lifting element is disposed to underlie the path of travel of the toy vehicles, the lifting element being positioned to engage the pendulum when the pendulum passes over the lifting element such that the engagement of the pendulum by the lifting element is operable to effect pivoting of the first coupling member from its coupling to its uncoupling position.

19 Claims, 3 Drawing Sheets

APPARATUS FOR UNCOUPLING TRACK-GUIDED TOY VEHICLES

BACKGROUND OF THE INVENTION

This invention extends primarily to large toy railroads of size G, scale 1:22.5, and track width of 45 mm. It is possible to construct conventional, electric uncouplers, as well as mechanical constant uncouplers, which can be put in place only on straight pieces of rail. In this nominal size such uncouplers have a negative optical effect on the overall picture of internal and external installations. Furthermore, aside from higher manufacturing and purchase costs and utilizing a large amount of electric cable over a large distance, a control console must also be used for electric uncouplers. A further disadvantage is the constant uncoupling of the so-called constant uncoupler occurs even without wishing it to uncouple.

SUMMARY OF THE INVENTION

The invention provides for uncoupling which, as additional equipment is used with the conventional coupling hook, can be used on the whole model train installation, that is, even as it curves on a curved track. Due to the introduction of the hardly visible lifting element, even in larger numbers, the optically created authenticity effect of model train installations of this nominal size is not affected negatively. Due to the interaction of the lifting element with the uncoupling pendulum mounted on a locomotive, railroad cars can be shunted at any place, since the locomotive can uncouple such railroad cars independently with the help of the uncoupling apparatus. The material of construction preferably is plastic, namely brown, black or transparent plexiglass. All other colors can also be selected. Under certain circumstances, however, these colors can make the components too conspicuous. Since the weatherproofness of this nominal size, which has been described, is not to be limited, the subsequently horizontally mounted axle, is used in the form of a screw or bolt of a corrosion-resistant material. The drawings showing the plane of the rails is intended to make it clear how independently one can uncouple at railroad stations or shunting tracks. The drawings show the inserted lifting elements through the arrangement of which this is made possible.

DESCRIPTION OF THE PREFERRED EMBODIMENTS

Figure 1A:
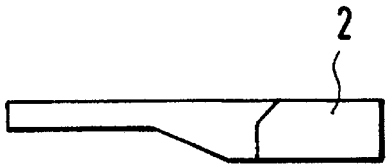
FIG. 1*a* is an elevational view of the counterpart coupling component to which the coupling of FIG. 1 is coupled.
Figure 1:
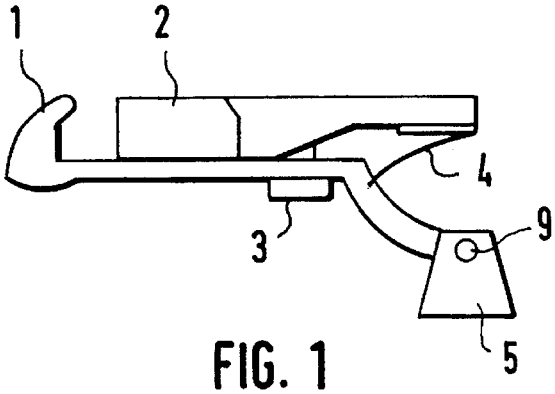
FIG. 1 is an elevational view of a coupling showing the coupling pendulum according to one embodiment of the invention.
Figure 1C:
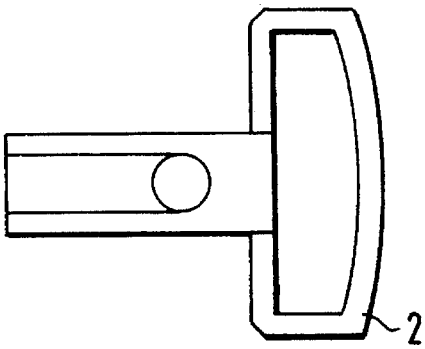
FIG. 1*c* is a plan view of FIG. 1*a*.
Figure 1B:
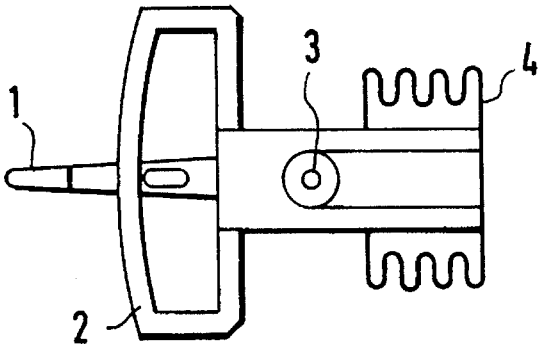
FIG. 1*b* is a plan view of FIG. 1.

In the drawings, a coupling member 1 is pivotal about a pivotal support 3 extending from the coupling support member 2. A spring 4 mounted on the coupling support member 2 extends to a position to engage the coupling member 1 in order to bias the coupling member 1 in a pivotal clockwise position so that the coupling member 1 is biased to a position as shown in FIG. 1. A pendulum 5 is pivotally supported on the coupling member 1 by pivot means 9.

The toy vehicle is adapted to move along rails 7 disposed on spaced ties 6. A lifting means 8 is disposed on the ties and is adapted to be engaged by the pendulum 5 as will be described hereinafter.

The pivot means 9 which pivotally supports the pendulum 5 includes a screw element disposed in a drilled hole.

Figure 2:
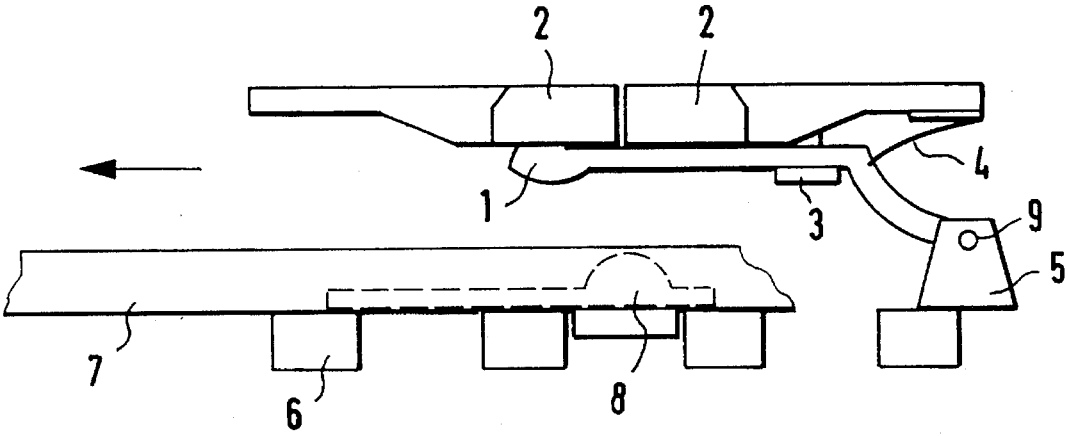
FIG. 2 is an elevational view of the two coupling components shown in an uncoupled position and also showing the lifting element which is disposed on the railroad ties.
Figure 3:
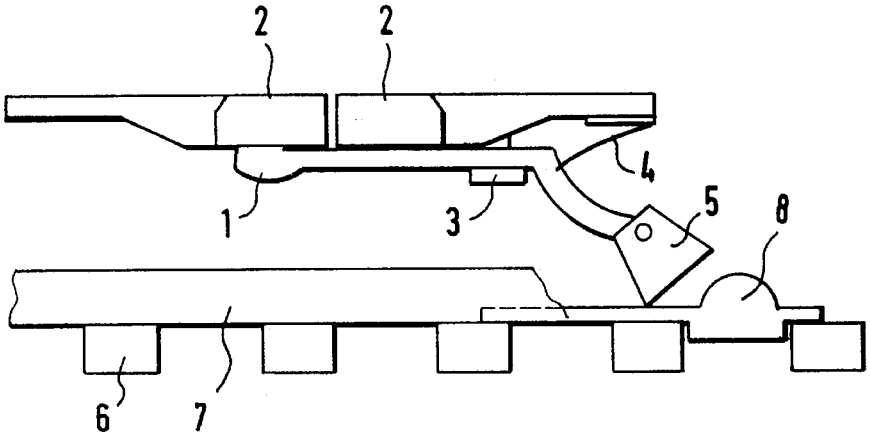
FIG. 3 is a view similar to FIG. 2 but showing another position wherein the coupling components have moved to the left from the FIG. 2 position.

As shown in FIG. 2, when travelling in the direction of the arrow shown in FIG. 2, the pendulum 5 passes over the railroad ties 6 without touching them, that is, there is a clearance between the bottom surface of the pendulum 5 and the upper surface of the ties 6. As the toy vehicle continues to move to the left from the FIG. 2 position to the FIG. 3 position, the pendulum 5 engages the lifting means 8 and such engagement causes the pendulum 5 to tilt towards the rear and is thus pulled over the lifting element 8 until it reaches the position shown in FIG. 3 wherein the corner of the pendulum 5 is disposed on the flat base portion of the lifting means 8. The upper surface of the flat base portion of the lifting means 8 is disposed at a higher elevation than the upper surface of the ties 6 such that the pendulum 5, when engaging the upper surface of the flat portion of the lifting means, is tilted as shown in FIG. 3.

Figure 4:
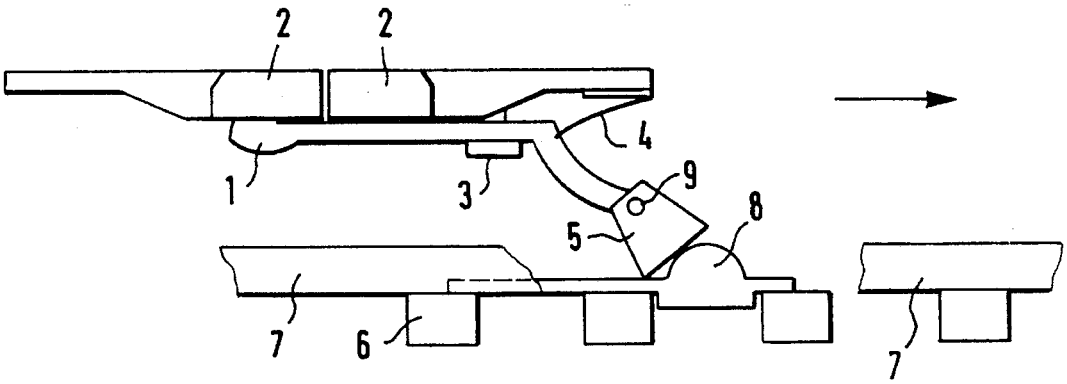
FIG. 4 is a view similar to FIG. 3 but showing the coupling components moved to the right from the position shown in FIG. 3.
Figure 5:
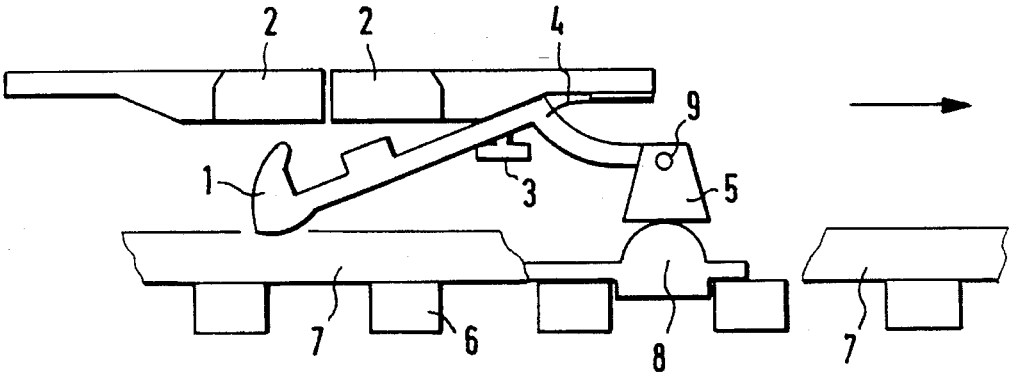
FIG. 5 is a view similar to FIG. 4 but showing the coupling components moved further to the right from the position shown in FIG. 4 and also showing the uncoupled position of the coupling components.

Subsequently, the direction of the toy vehicle is reversed in the direction shown by the arrow in FIG. 4 wherein the bottom of the pendulum 5 engages the arcuate surface 8 of the lifting means and, upon further movement of the toy vehicle in the reverse direction, the pendulum 5 reaches an upright position as shown in FIG. 5. However, in doing so, the coupling element 1 is pivoted counterclockwise to the position shown in FIG. 5. When the pendulum 5 moves from the FIG. 4 to the FIG. 5 position, it causes the coupling element 1 to pivot from the FIG. 4 to the FIG. 5 position against the bias of the spring 4. FIG. 5 shows the uncoupled position wherein the coupling element 1 will be displaced or unhooked from the other coupling element 2 such that the toy vehicle on which the coupling element 1 is mounted can continue to the right and be uncoupled.

Figure 6:
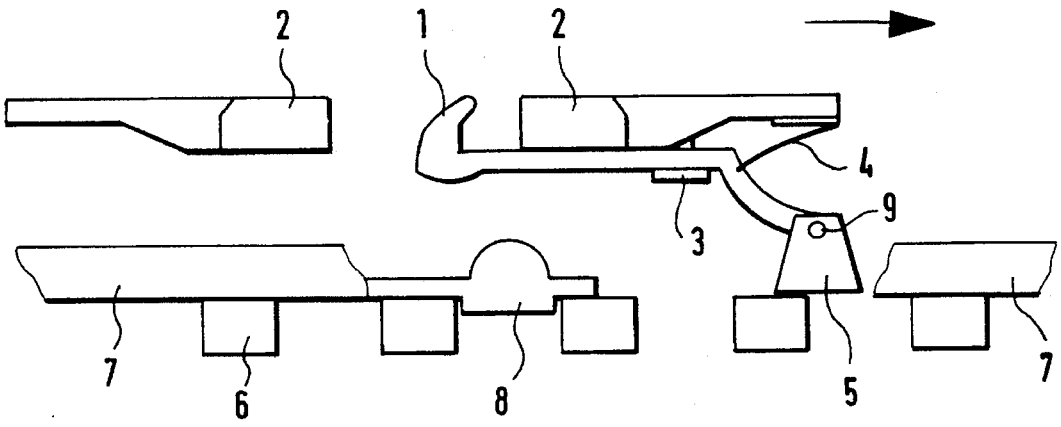
FIG. 6 is a view similar to FIG. 5 but showing the coupling component with the pendulum moved further to the right from the position shown in FIG. 5 and showing the uncoupled position of the coupling components.

As the toy vehicle continues to move further to the right from the FIG. 5 to the FIG. 6 position, the pendulum 5 passes beyond the lifting means 8 whereupon the spring 4 pivots the coupling element clockwise from the FIG. 5 position to the position shown in FIG. 6, but at this time it has been uncoupled from the coupling element 2 as shown in FIG. 6. Also as shown in FIG. 6, the pendulum 5 now assumes its original position where it is freely suspended from the coupling element 1 with a clearance between the bottom of the pendulum 5 and the upper surface of the ties 6.

The uncoupling of the coupling element can be readily understood by following the sequence of operation in applicant's FIGS. 2 to 6, the vehicles being coupled in FIG. 2 and the vehicles being uncoupled in FIG. 6.

The weight of the pendulum 5 tends to cause the first coupling element to pivot toward the coupling position. As show in the drawings, the pendulum 5 has a bottom portion wider than the top portion and is trapezoidal in shape with a top wall parallel to a bottom wall. The bottom surface of the pendulum 5 and the surface of the elevated part 8 consists of a smooth, rough, or intended surface. The lifting element 8 has a lower projection which is disposed between the railroad ties 6 to keep the lifting element 8 from shifting. The elevated portion of the lifting means 8 has a semicircular, arcuate or sloped shape as shown, for example, in applicant's FIG. 2. In FIG. 3, for example, when the pendulum 8 moves past the elevated portion 8, the bottom surface of the pendulum 5 is disposed at an acute angle relative to the upper surface of the base portion.

If the direction of travel is to be changed without uncoupling, it is only necessary to halt where the pendulum 5 can hang down vertically. This is advisable, for example, when shunted toy vehicles are being coupled once again in the vicinity of the lifting means 8.

Figure 7A:
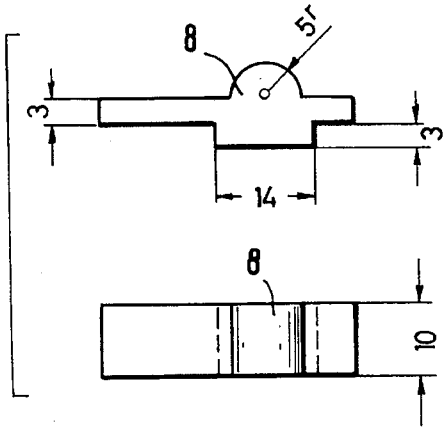
FIG. 7*a* is an elevational view and a plan view of the lifting element.
Figure 7B:
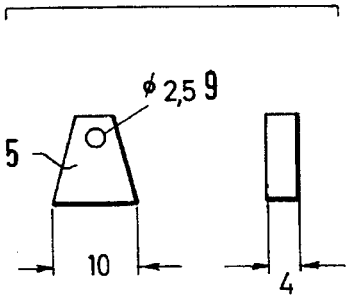
FIG. 7*b* is a side elevational view and a front elevational view of the pendulum.

FIG. 7 shows the uncoupling pendulum 5 as well as the lifting means 8 with the proposed dimensions shown which permit certain differences without limiting the function. The dimensions are given in millimeters. If the differences are fully exhausted, there may be changes which then change the appearance of the uncoupling pendulum 5 and of the lifting means 8 visibly.

What I claim is:

1. Apparatus for automatically uncoupling track-guided toy vehicles comprising a first coupling element adapted to be pivotally mounted on one toy vehicle for pivotal movement between a coupling position and an uncoupling position, a second coupling element adapted to be disposed on another toy vehicle, said first coupling element coupling with said second coupling element when said first coupling element is in said coupling position, said first coupling element uncoupling from said second coupling element when said first coupling element is in said uncoupling position, a spring means pivotally biasing said first coupling element in said coupling position, a pendulum, pivot means pivotally suspending said pendulum from said first coupling member, a lifting means disposed to underlie the path of travel of said toy vehicles, said lifting means having an elongated base section having an upper surface and an elevated part engageable by said pendulum to effect pivoting of said first coupling member from said coupling position to said uncoupling position, said upper surface for facilitating sliding of said pendulum on said upper surface as said one toy vehicle moves along its path of travel.

2. Apparatus according to claim 1 wherein said pendulum and said lifting means are made of weatherproof material.

3. Apparatus according to claim 2 wherein said weatherproof material is plastic.

4. Apparatus according to claim 1 wherein said pendulum has a top portion and a bottom portion, said bottom portion being wider than said top portion, said pivot means being disposed in said top portion.

5. Apparatus according to claim 4 wherein said bottom portion of said pendulum has an engageable surface which is engaged by said elevated part of said lifting means.

6. Apparatus according to claim 5 wherein said engageable surface comprises a surface selected from the group consisting of a smooth surface, a rough surface and an indented surface.

7. Apparatus according to claim 1 wherein said elongated section of said lifting means is operable to engage said pendulum to maintain a pivoted position of said pendulum when said one toy vehicle passes over said elongated section of said lifting means.

8. Apparatus according to claim 7 wherein said elevated part has an arcuate configuration.

9. Apparatus according to claim 7 wherein said elevated part has a sloping configuration.

10. Apparatus according to claim 7 wherein said elevated part comprises a surface selected from the group consisting of a smooth surface, a rough surface and an indented surface.

11. Apparatus according to claim 7 wherein said elevated part of said lifting means has a semicircular configuration.

12. Apparatus according to claim 1 wherein said track-guided toy vehicle is adapted to travel on tracks disposed on a track-supporting surface, said pendulum having a generally flat bottom, said pendulum having a suspended position in which said flat bottom is generally parallel to said track-supporting surface and in which said flat bottom is spaced from said track-supporting surface.

13. Apparatus for automatically uncoupling track-guided toy vehicles comprising a first coupling element adapted to be pivotally mounted on one toy vehicle for pivotal movement between a coupling position and an uncoupling position, a second coupling element adapted to be disposed on another toy vehicle, said first coupling element coupling with said second coupling element when said first coupling element is in said coupling position, said first coupling element uncoupling from said second coupling element when said first coupling element is in said uncoupling position, a spring means pivotally biasing said first coupling element in said coupled position, a pendulum, pivot means pivotally suspending said pendulum from said first coupling member, a lifting means disposed to underlie the path of travel of said toy vehicles, said lifting means being positioned to engage said pendulum when said pendulum passes above said lifting means such that said engagement of said pendulum by said lifting means is operable to effect pivoting of said first coupling element from said coupling to said uncoupling position, said track-guided toy vehicle adapted to travel on tracks disposed on a plurality of spaced ties, said lifting means comprising a lifting element disposed on said ties, said lifting element having a lower projection disposed in the space between two juxtaposed ties to keep the lifting element from shifting.

14. Apparatus for automatically uncoupling track-guided toy vehicles comprising a first coupling element adapted to be pivotally mounted on one toy vehicle for pivotal movement between a coupling position and an uncoupling position, a second coupling element adapted to be disposed on another toy vehicle, said first coupling element coupling with said second coupling element when said first coupling element is in said coupling position, said first coupling element uncoupling from said second coupling element when said first coupling element is in said uncoupling position, a spring means pivotally biasing said first coupling element in said coupled position, a pendulum, pivot means pivotally suspending said pendulum from said first coupling member, a lifting means disposed to underlie the path of travel of said toy vehicles, said lifting means being positioned to engage said pendulum when said pendulum passes above said lifting means such that said engagement of said pendulum by said lifting means is operable to effect pivoting of said first coupling element from said coupling to said uncoupling position, said track-guided toy vehicle adapted to travel on tracks disposed on a track-supporting surface, said pendulum having a generally flat bottom, said pendulum having a suspended position in which said flat bottom is generally parallel to said track-supporting surface and in which said flat bottom is spaced from said track-supporting surface, said pendulum having a cross-sectional configuration in the form of a trapezoid including a top wall parallel to said flat bottom and with said flat bottom being longer than said top wall.

15. Apparatus for automatically uncoupling track-guided toy vehicles comprising a first coupling element adapted to be pivotally mounted on one toy vehicle for pivotal movement between a coupling position and an uncoupling position, a second coupling element adapted to be disposed on another toy vehicle, said first coupling element coupling with said second coupling element when said first coupling element is in said coupling position, said first coupling element uncoupling from said second coupling element when said first coupling element is in said uncoupling position, a spring means pivotally biasing said first coupling element in said coupled position, a pendulum, pivot means pivotally suspending said pendulum from said first coupling member, a lifting means disposed to underlie the path of travel of said toy vehicles, said lifting means being positioned to engage said pendulum when said pendulum passes above said lifting means such that said engagement of said pendulum by said lifting means is operable to effect pivoting of said first coupling element from said coupling to said uncoupling position, said track-guided toy vehicle adapted to travel on tracks disposed on a track-supporting surface, said pendulum having a generally flat bottom, said pendulum having a suspended position in which said flat bottom is generally parallel to said track-supporting surface and in which said flat bottom is spaced from said track-supporting surface, said lifting means having a base portion having an upper surface and an elevated portion projecting to a higher elevation than said upper surface of said base portion, said pendulum being engaged by said elevated portion of said lifting means when said toy vehicle moves in one direction over said elevated portion of said lifting means to thereby pivot said pendulum in one pivotal direction while said first coupling element remains in its coupling position, said pendulum being subsequently engaged by said upper surface of said base portion of said lifting means as said toy vehicle continues to move in said one direction past said elevated portion of said lifting means, said pendulum when engaged by said upper surface of said base portion having its flat bottom disposed at an acute angle relative to said upper surface of said base portion, said first coupling element remaining in its coupling position when said pendulum is engaged by said upper surface of said base portion of said lifting means, said flat bottom of said pendulum engaging said elevated portion of said lifting means when said toy vehicle subsequently moves in an opposite direction such that when said toy vehicle continues to move in said opposite direction, the engagement between said flat bottom of said pendulum and said elevated portion of said lifting means effects pivoting of said pendulum about said pivot means and pivoting of said first coupling element from said coupling to said uncoupling position, whereby movement of said toy vehicle over said lifting means in said one direction followed by movement over said lifting means in said opposite direction effects automatic uncoupling of said toy vehicles.

16. Apparatus according to claim 15 wherein said pendulum has a side wall which extends to said flat bottom to define a pendulum corner where said side wall joins said flat bottom, said pendulum when being engaged by said upper surface of said base portion with said flat bottom being disposed at an acute angle relative to said upper surface of said base portion of said lifting means being in an intermediate engaged position, said pendulum corner engaging said upper surface of said base portion of said lifting means when said pendulum is in said intermediate engaged position.

17. Apparatus according to claim 16 wherein said elevated portion of said lifting means has a top, said intermediate engaged position of said pendulum being designated a first intermediate engaged position, said pendulum moving from said first intermediate engaged position to a second intermediate engaged position when said toy vehicle moves in said opposite direction from said first intermediate engaged position, said pendulum engaging said top of said elevated portion of said lifting means when said pendulum is in said second intermediate engaged position, said pendulum being operable to pivot said first coupling element from said coupling position to said uncoupling position when said pendulum moves from said first intermediate engaged position to said second intermediate engaged position.

18. Apparatus according to claim 17 wherein said flat bottom of said pendulum is generally parallel to said track-supporting surface when said pendulum is in said second intermediate engaged position.

19. Apparatus according to claim 15 wherein said upper surface of said base portion of said lifting means is disposed at an elevation higher than said track-supporting surface.

* * * * *